US005521622A

United States Patent [19]

Hock et al.

[11] Patent Number: 5,521,622

[45] Date of Patent: May 28, 1996

[54] PRINT QUALITY OPTIMIZATION FOR A COLOR INK-JET PRINTER BY USING A LARGER NOZZLE FOR THE BLACK INK ONLY

[75] Inventors: Scott W. Hock, San Diego; David A. Johnson, Fallbrook; Mark A. Van Veen, Ramona, all of Calif.

[73] Assignee: Hewlett-Packard Company, Palo Alto, Calif.

[21] Appl. No.: 320,104

[22] Filed: Oct. 7, 1994

Related U.S. Application Data

[63] Continuation of Ser. No. 874,925, Apr. 28, 1992, abandoned.

[51] Int. Cl.[6] ..... B41J 2/21

[52] U.S. Cl. ..... 347/43; 347/95; 347/102

[58] Field of Search ..... 347/5, 15, 17, 347/20, 43, 47, 85, 95, 102, 93; 206/20 R, 22 R

[56] References Cited

U.S. PATENT DOCUMENTS

| | | | |
|---|---|---|---|
| 4,631,548 | 12/1986 | Milbrandt | 347/43 |
| 4,682,216 | 7/1987 | Sasaki et al. | 347/43 X |
| 4,751,528 | 6/1988 | Spehrley, Jr. et al. | 347/102 |
| 4,791,435 | 12/1988 | Smith et al. | 347/17 X |
| 4,875,059 | 10/1989 | Masuda et al. | 347/93 |
| 4,965,595 | 10/1990 | Yoshimura | 347/43 X |
| 4,982,207 | 1/1991 | Tunmore et al. | 347/102 |
| 4,994,110 | 2/1991 | Stoffel et al. | 106/22 |
| 5,041,846 | 8/1991 | Vincent et al. | 347/102 |

FOREIGN PATENT DOCUMENTS 190862 10/1984 Japan .

*Primary Examiner*—John E. Barlow, Jr.

[57] ABSTRACT

The diameter of nozzles in a nozzle plate used in ink-jet printer pens, or cartridges, for the black ink is set at a first value, e.g., 45 μm, which is larger than that used for the color inks, e.g., 40 μm. It has been found that merely changing the nozzle diameter is sufficient to change the ink droplet size. By designing the drop mass properly (i.e., lower than normal, with the volume of black ink at, for example 115 pl and the volume of color ink at, for example, 95 pl, as measured at room temperature), optimum print quality and reliability is achieved when the cartridge reaches steady state operating temperature in a printer provided with a heater to assist in drying the ink on the print medium. The inventive approach has several advantages over previous designs, including: (1) optimization/testing of the barriers and resistor topology is done only once for the cyan, yellow, magenta, and black cartridges; (2) operating energy in the printer is the same for the cyan, yellow, magenta, and black cartridges, thus simplifying the product design; and (3) manufacturing is greatly simplified, since the only part, other than the ink and some packaging, that is different between the black and color cartridges is the top nozzle plate.

17 Claims, 1 Drawing Sheet

FIG. 1
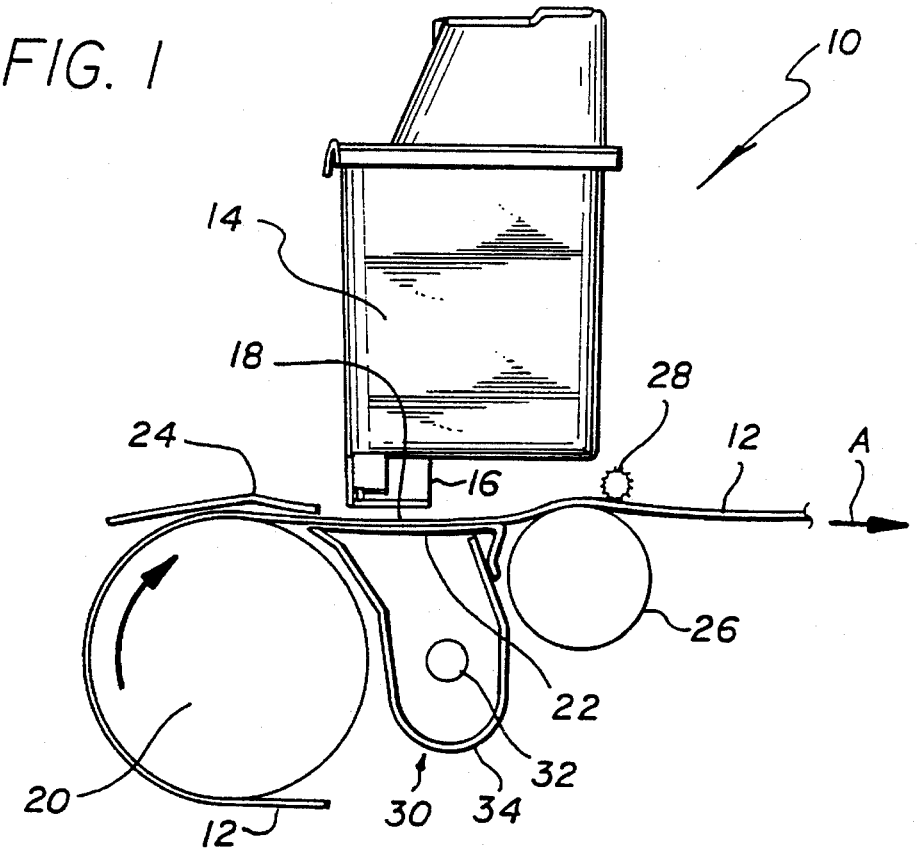
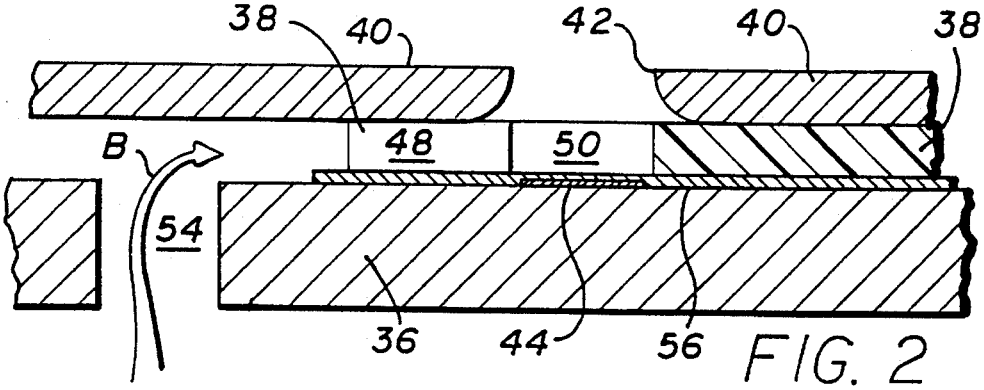
FIG. 2
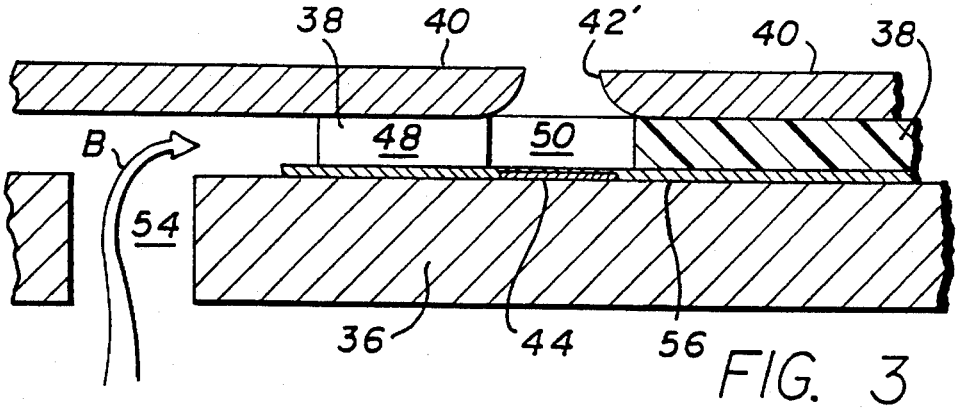
FIG. 3

PRINT QUALITY OPTIMIZATION FOR A COLOR INK-JET PRINTER BY USING A LARGER NOZZLE FOR THE BLACK INK ONLY

CROSS REFERENCE TO RELATED APPLICATION

This is a continuation of application Ser. No. 07/874,925 filed on Apr. 28, 1992, now abandoned.

TECHNICAL FIELD

The present invention relates generally to thermal ink-jet printers and, more particularly, to CYMK (cyan, yellow, magenta, black) color thermal ink-jet printers employing a heating means to assist in drying the ink after it is jetted onto a print medium.

BACKGROUND ART

Thermal ink-jet printers operate by using a resistance element that is controllably energized to expel ink droplets through a nozzle onto a print medium. Each heater resistor and its associated nozzle is located in a firing chamber, into which ink is introduced from an ink refill slot via an ink feed channel. There are typically a plurality of heater resistors and associated nozzles in a given printhead, permitting the printing of alphanumeric characters, area-fill, and the like.

In previous Hewlett-Packard color ink-jet printers having a resolution of 180 dots-per-inch, satisfactory printing was obtained using the same nozzle diameters for the color inks and for the black ink.

However, in a higher resolution color ink-jet printer, it is desirable to have a larger drop mass for the black cartridge than for the CYM cartridges. This is because the black dots on paper are made from a single color and must be made larger to accommodate this fact as well as achieve optimal text print quality, which requires larger drop mass. Since red, green, and blue are made from two drops (see the Table below), the resultant dot size on the print medium is larger than for cyan, yellow, or magenta alone.

Table

| | Printing Color in a CYMK Printing System | | | | |
|---|---|---|---|---|---|
| | Cartridge Colors | | | | # of |
| Desired Color | Cyan | Yellow | Magenta | Black | Drops |
| Cyan | X | | | | 1 |
| Yellow | | X | | | 1 |
| Magenta | | | X | | 1 |
| Red | | X | X | | 2 |
| Green | X | X | | | 2 |
| Blue | X | | X | | 2 |
| Black | | | | X | 1 |

If the same larger drop mass from the black cartridge is used for the cyan, yellow, and magenta cartridges, the resultant red, green, and blue dot size would be unacceptably large. By designing a lower drop mass cartridge for the cyan, yellow, and magenta colors, optimal dot size is achieved for all colors (C,Y,M,R,G,B,K).

Furthermore, in a heated printing system, the drop mass of all cartridges will increase as the cartridge heats up from being exposed to the heated printing environment.

Prior solutions to the problem of droplet size have been accomplished by using totally different architectures for the color and black cartridges. For example, U.S. Pat. No. 4,746,935, issued to Ross R. Allen and assigned to the same assignee as the present application, teaches that in order to change the droplet size, the size of the resistor, the nozzle, the firing chamber, and the ink feed channel all must be changed. Smaller size droplets are created by reducing all four elements relative to those for a larger size droplet.

There remains a need to provide a pre-determined droplet size, yet keep the pen architecture as simple as possible.

DISCLOSURE OF INVENTION

In accordance with the invention, the diameter of the nozzles for the black ink is set at a first value, which is larger than that used for the color inks. It has been found that merely changing the nozzle diameter is sufficient to change the droplet size.

By designing the drop mass properly (i.e., lower than normal), optimum print quality and reliability is achieved when the cartridge reaches steady state operating temperature. This mode of operation has been termed "hot head". Pens used in a heated thermal ink-jet printing system cannot be run in a "cold" (i.e., ambient) environment and achieve optimal print quality.

This invention achieves optimum print quality and reliability under hot head conditions by only changing the orifice size in the top nozzle plate of the printhead. This method of achieving the desired drop masses has several advantages over previous designs:

(1) Optimization/testing of the barriers and resistor topology is done only once for the cyan, yellow, magenta, and black cartridges.

(2) Operating energy in the printer is the same for the cyan, yellow, magenta, and black cartridges, thus simplifying the product design. Common energy requirements for all cartridges is not assured with the previous designs.

(3) Manufacturing is greatly simplified, since the only part, other than the ink and some packaging, that is different between the black and color cartridges is the top nozzle plate.

BRIEF DESCRIPTION OF THE DRAWINGS

FIG. 1 is a schematic drawing of a portion of a thermal ink-jet printer, employing heating means, depicting the relation of the print cartridge with its printhead to the print medium and heating means;

FIG. 2 is a cross-sectional view of a portion of a printhead in a black ink cartridge, depicting one heater resistor and its associated nozzle; and FIG. 3 is a view similar to that of FIG. 2, but for a printhead in color ink cartridges.

BEST MODES FOR CARRYING OUT THE INVENTION

FIG. 1 depicts an ink-jet printer 10, showing a portion thereof only, comprising a print medium 12 moved past a print cartridge, or pen, 14 having affixed thereto a printhead 16 in operative association with the print medium. The printhead 16 establishes a print zone 18. As is customary, the print medium 12 is moved along a paper path in the printer, in the direction denoted by the arrow A, and the print cartridge 14 is moved orthogonal thereto. The print medium 12 is moved by a drive roller 20 onto a screen 22. A drive plate 24, positioned after the drive roller 20 and prior to the print cartridge 14 aids in holding print medium 12 flat on the screen 22. The screen 22, which acts like a platen, is perforated so as to permit the drying of the print medium, as described more fully below. The print medium 12 exits the print zone 18 by means of an exit roller 26 and a plurality of starwheels 28 to be collected in a paper collection means, such as a tray (not shown).

A recent modification in thermal ink-jet printers involves the use of a heating means, generally depicted at 30, which is positioned close to the print zone 18. In FIG. 1, the heating means 30 is depicted as comprising a print heater 32 and a reflector 34, which serves to concentrate the heat on the bottom of the print medium 12, through the screen 22. However, it will be readily apparent to those skilled in the art that the heating means 30 may comprise any of the usual heat sources, such as heating elements, blowers, and the like, and the invention is not so limited as to the heating source. Nor is the invention limited to the placement of the heating source, which may be ahead of the print zone 18, behind the print zone, or in the print zone or which may be located beneath the print medium 12, as shown, or above it.

FIGS. 2 and 3 depict in cross-section a portion of the printhead 16, comprising a substrate 36, a barrier layer 38, and an orifice plate, or member, 40 with an opening, or nozzle, 42 therein. The nozzle 42 is positioned above a thermal element 44, commonly a resistor element, or heater-resistor. In practice, the orifice plate 40 has a plurality of nozzles 42 in it, each one operatively associated with a resistor 44, as is well-known. The present invention is not limited to the particular orifice member 40 employed, which may be separate or integral with the barrier layer 38. Indeed, any orifice member overlying the thermal element 44 may be employed in the practice of the invention.

In operation, ink fills an ink feed channel 48, as shown by arrow B; each resistor is fed by such a channel, which is defined by the substrate 36, the barrier layer 38, and the orifice plate 40. Each resistor 44 is connected by an electrically conductive trace (not shown) to a current source, which, under control of a computer (not shown), sends current pulses to selected resistors 44, causing a droplet of ink to be expelled through the nozzle 42 and onto the print medium 12 in a desired pattern of alphanumeric characters, area fill, and other print patterns. The details of such thermal ink-jet printers are described, for example, in the *Hewlett-Packard Journal,* Vol. 36, No. 5, May 1985, and do not form a part of this invention.

FIGS. 2 and 3 also depict the ink flow path, shown by arrow B, up through ink refill slot 54, into the ink feed channel 48, and into firing chamber 50. A passivation layer 56 lies over the substrate 36 and the resistor 44. This passivation layer typically comprises a silicon nitride-silicon carbide material, as is well-known. Additionally, there are several other layers in the thin film construction of an ink-jet printhead; these are omitted from the drawing for clarity.

FIGS. 2 and 3, although not drawn to scale, are drawn so as to be consistent with each other. FIG. 2 depicts a portion of a printhead for a black ink cartridge. In accordance with the invention, the diameter of the black ink nozzle 42 is about 45 μm. FIG. 3, which is a similar view to FIG. 2, depicts a portion of a printhead for a color ink cartridge. In accordance with the invention, the diameter of the color ink nozzle 42' is about 40 μm.

As indicated earlier, the amount of black ink to be delivered to the print medium 12 must be larger, due to text considerations and to the fact that only one dot of ink is required per pixel on the printed medium, compared with printing a color, which, depending on the color, may require one or two dots of ink per pixel.

The situation is further complicated by the presence of the heater 30 associated with the printer 10, which is positioned so as to dry the ink relatively quickly on the print medium 12. While the nozzle diameter for room temperature thermal ink-jet printers is typically about 52 μm, such nozzle diameters in heated thermal ink-jet printers would result in a substantially increased droplet volume, with loss of print quality due to bleed of adjacent colors and excessively bold characters.

In the presently preferred embodiment of the invention, the heater printer employed is designed to provide at least 300 dot-per-inch (DPI) resolution; higher resolution is also contemplated. However, the invention is not limited to such higher resolutions, and is also useful in printers providing a resolution of more than 180 DPI. In all such printers, it is desired to place dots on the print medium 12 so that when adjacent dots grow on paper, they will just touch when dry.

The use of nozzle diameters given above in a thermal ink-jet printer provides about 115 pl of black ink (45 μm diameter nozzle) and about 95 pl of color ink (40 μm diameter nozzle), measured at ambient conditions. (In the heated environment, the drop volume increases by about 1 pl/°C.) The three-sigma limit in both cases is about 12 pl, and is dictated by manufacturing tolerances.

Importantly, it will be appreciated that the change in nozzle diameter only is sufficient to create the requisite change in droplet size. As a consequence, the size of the heater resistor 44 is maintained at the same size, as are the dimensions of the firing chamber 50 and ink feed channel 48. Thus, manufacturing costs are kept low, since the only difference between the color printheads and the black printhead is the nozzle plate 40, with its given nozzle diameters.

In the color thermal ink-jet printer with modified printhead as described above, the following ink formulations are preferably employed:

Cyan:
- about 5 to 15 wt %, and preferably about 7.9 wt %, diethylene glycol,
- about 0.5 to 5.0 wt %, and preferably about 1.1 wt %, Acid Blue dye (sodium cations),
- about 0.1 to 1.0 wt % bactericide, and preferably about 0.3 wt % NUOCEPT biocide (NUOCEPT is a tradename of Hüls America, Piscataway, N.J.),
- balance water;

Yellow:
- about 5 to 15 wt %, and preferably about 5.4 wt %, diethylene glycol,
- about 0.5 to 5.0 wt %, and preferably about 1.25 wt %, Acid Yellow 23 dye (tetramethylammonium cations),
- about 0.1 to 1.0 wt % bactericide, and preferably about 0.3 wt % NUOCEPT biocide,
- about 0.08 wt % buffer, preferably potassium phosphate,
- balance water;

Magenta:
- about 5 to 15 wt %, and preferably about 7.9 wt %, diethylene glycol,
- about 0.5 to 5.0 wt %, and preferably about 2.5 wt %, Direct Red 227 dye (tetramethylammonium cations),
- about 0.1 to 1.0 wt % bactericide, and preferably about 0.3 wt % NUOCEPT biocide,
- balance water; and Black:

about 5 to 15 wt %, and preferably about 5.5 wt %, diethylene glycol, about 0.5 to 5.0 wt %, and preferably about 2.5 wt %, Food Black 2 dye (lithium cations), about 0.05 to 1.0 wt % bactericide, and preferably about 0.08 wt % PROXEL biocide (PROXEL is a tradename of ICI America), about 0.2 wt % buffer, preferably sodium borate, balance water.

The ink 46 that enters the ink refill slot 54 is provided from a reservoir (not shown) either contained within the body of the print cartridge 14 or external thereto. In a color printer, one or more print cartridges, each cartridge associated with one or more ink reservoirs, may be employed.

INDUSTRIAL APPLICABILITY

The use of a larger nozzle diameter in printheads for black ink cartridges and a smaller nozzle diameter in printheads for color ink cartridges is expected to find use in thermal ink-jet printers employing heating means for assisting in the drying of ink.

Thus, there has been disclosed a structure in black and color printheads for optimizing print quality and reliability in a CYMK printing system. It will be readily apparent to those of ordinary skill in the art that various changes and modifications of an obvious nature may be made without departing from the spirit of the invention, and all such changes and modifications are considered to fall within the scope of the invention as defined by the appended claims.

What is claimed is:

1. An inkjet printer having a print zone located in a media path, comprising:

heating means for heating the print zone;

a first printhead located adjacent to the print zone and having a first ink firing chamber with a first ink actuation element and a first nozzle orifice;

an ink feed channel for supplying black ink to said first firing chamber;

at least three additional printheads located adjacent to the print zone and each having second ink firing chambers with a second ink actuation element and a second nozzle orifice; and ink feed channel means for supplying different primary color inks to each of said at least three additional printheads, printing of two different primary color ink dots overlapping one another on a media forming a single secondary color dot having a diameter larger than a diameter of a single primary color dot printed on said media, wherein all of said black ink and primary color inks are liquid at room temperature, with the size and dimensions of said first ink firing chamber and said second ink firing chamber being substantially the same, with the size of said first actuation element and said second actuation element being substantially the same, but with said first nozzle orifice having a diameter greater than the diameter of said second nozzle orifice in order to increase the drop size of black ink drops to be greater than the drop size of primary color ink drops when ink is applied to said media in a heated print zone, said first nozzle orifice being such that a printed black ink dot on said media has substantially the same diameter as a single printed secondary color dot on said media formed by two overlapping primary color ink dots.

2. The thermal ink-jet pen of claim 1 wherein said primary color inks comprise cyan, yellow, and magenta colors.

3. The thermal ink-jet pen of claim 2 wherein said inks are given by the formulation Cyan:

about 5 to 15 wt % diethylene glycol, about 0.5 to 5.0 wt % Acid Blue dye (sodium cations), about 0.1 to 1.0 wt % bactericide, balance water;

Yellow:

about 5 to 15 wt % diethylene glycol, about 0.5 to 5.0 wt % Acid Yellow 23 dye (tetramethylammonium cations), about 0.1 to 1.0 wt % bactericide, about 0.08 wt % buffer, balance water;

Magenta:

about 5 to 15 wt % diethylene glycol, about 0.5 to 5.0 wt % Direct Red 227 dye (tetramethylammonium cations), about 0.1 to 1.0 wt % bactericide, balance water; and Black:

about 5 to 15 wt % diethylene glycol, about 0.5 to 5.0 wt % Food Black 2 dye (lithium cations), about 0.05 to 1.0 wt % bactericide, about 0.2 wt % buffer, balance water.

4. The thermal ink-jet pen of claim 3 wherein said inks are given by the formulation Cyan:

about 7.9 wt % diethylene glycol, about 1.1 wt % Acid Blue dye (sodium cations), about 0.3 wt % biocide, balance water;

Yellow:

about 5.4 wt % diethylene glycol, about 1.25 wt % Acid Yellow 23 dye (tetramethylammonium cations), about 0.3 wt % biocide, about 0.08 wt % potassium phosphate buffer, balance water;

Magenta:

about 7.9 wt % diethylene glycol, about 2.5 wt % Direct Red 227 dye (tetramethylammonium cations), about 0.3 wt % biocide, balance water; and Black:

about 5.5 wt % diethylene glycol, about 2.5 wt % Food Black 2 dye (lithium cations), about 0.08 wt % biocide, about 0.2 wt % sodium borate buffer, balance water.

5. The thermal ink-jet pen of claim 2 wherein said diameter of nozzles associated with said first ink activation element firing black ink is about 45 μm and wherein the diameter of nozzles associated with said second ink activation element firing any of cyan, yellow, and magenta inks is about 40 μm.

6. The thermal ink-jet pen of claim 2 wherein the volume of black ink droplets is about 115 pl and wherein the volume of any of cyan, yellow, and magenta inks is about 95 pl, as measured at room temperature.

7. The thermal ink-jet pen of claim 1 wherein a heated environment caused by said heating means exposes said pen to a temperature of about 20° to 25° C. above ambient temperature.

8. The printer of claim 1 wherein said primary color inks are cyan, yellow and magenta, and with cyan, yellow, magenta and black pixels being printed with a total of one drop/pixel, and with said secondary colors red, green and blue being printed with a total of two drops/pixel.

9. The printer of claim 1 wherein said first printhead further comprises a plurality of ink firing chambers, ink actuation elements, and nozzle orifices substantially identical to said first ink firing chamber, said first ink actuation element, and said first nozzle orifice, respectively, and each printhead among said at least three additional printheads further comprises a plurality of ink firing chambers, ink actuation elements, and nozzle orifices substantially identical to said second ink firing chamber, said second ink actuation element, and said second nozzle orifice, respectively.

10. The printer of claim 1 wherein each printhead of said at least three additional printheads is provided in a separate cartridge associated with a single primary color.

11. A method of color printing in an inkjet printer comprising the steps of:

heating a print zone and media passing through the print zone;

firing black ink drops of a first size through an enlarged diameter nozzle orifice of a black printhead;

firing primary color ink drops of a second size through a nozzle orifice of a color printhead, with said black ink firing step producing black ink drops which are greater in size than the size of primary color ink drops produced by said color ink firing step, said black ink drops forming a dot on said media having substantially the same diameter as a single printed secondary color dot on said media formed by two overlapping primary color ink drops.

12. A method of color printing in an inkjet printer, said printer having a first plurality of nozzles for ejecting black ink, a second plurality of nozzles for ejecting a first primary color ink, a third plurality of nozzles for ejecting a second primary color ink, and a fourth plurality of nozzles for ejecting a third primary color ink, nozzles within said first plurality of nozzles having a diameter larger than the diameter of nozzles within said second, third, and fourth plurality of nozzles, said method comprising the steps of:

firing black ink drops of a first size through one or more enlarged diameter nozzles in said first plurality of nozzles;

firing primary color ink drops of a second size through one or more nozzles in at least one of said first plurality of nozzles, said second plurality of nozzles, and said third plurality of nozzles, with said black ink firing step producing black ink drops which are greater in size than the size of primary color ink drops produced by said color ink firing step, said black ink drops forming a dot on a media having substantially the same diameter as a single printed secondary color dot on said media formed by two overlapping primary color ink drops.

13. The method of claim 12 wherein said first primary color is cyan, said second primary color is magenta, and said third primary color is yellow.

14. The method of claim 13 wherein said secondary color dot is selected from the group consisting of a red dot, a green dot, and a blue dot, where said red dot is formed by overlapping yellow and magenta dots, where said green dot is formed by overlapping cyan and yellow dots, and where said blue dot is formed by overlapping cyan and magenta dots.

15. A method of color printing in an inkjet printer comprising the steps of:

heating a print zone and media passing through the print zone;

firing black ink drops of a first size through an enlarged diameter nozzle in a first plurality of nozzles for ejecting black ink;

firing primary color ink drops of a second size through a nozzle in a second plurality of nozzles for ejecting primary color ink, with said black ink firing step producing black ink drops which are greater in size than the size of primary color ink drops produced by said color ink firing step, said black ink drops forming a dot on said media having substantially the same diameter as a single printed secondary color dot on said media formed by two overlapping primary color ink drops.

16. The method of claim 15 wherein a first primary color is cyan, a second primary color is magenta, and a third primary color is yellow.

17. The method of claim 16 wherein said secondary color dot is selected from the group consisting of a red dot, a green dot, and a blue dot, where said red dot is formed by overlapping yellow and magenta dots, where said green dot is formed by overlapping cyan and yellow dots, and where said blue dot is formed by overlapping cyan and magenta dots.

* * * * *